US009568261B1

(12) United States Patent
Hall

(10) Patent No.: US 9,568,261 B1
(45) Date of Patent: Feb. 14, 2017

(54) FIREARMS RECEIVER WITH INTEGRATED LOCKING JOINT

(71) Applicant: Corby Hall, Henderson, TX (US)

(72) Inventor: Corby Hall, Henderson, TX (US)

( * ) Notice: Subject to any disclaimer, the term of this patent is extended or adjusted under 35 U.S.C. 154(b) by 0 days.

(21) Appl. No.: 14/955,247

(22) Filed: Dec. 1, 2015

Related U.S. Application Data

(60) Provisional application No. 62/233,809, filed on Sep. 28, 2015.

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41A 3/64; F41A 11/04; F41A 21/48; F41A 21/484; F41C 23/06; F41C 23/16
USPC ..... 42/75.01, 75.02, 75.03
See application file for complete search history.

(56) References Cited

U.S. PATENT DOCUMENTS 2,205,857 A * 6/1940 Marchand ..... F41A 21/482 42/75.01
3,206,885 A * 9/1965 Dye ..... F41C 23/00 42/75.03
3,208,178 A * 9/1965 Seiderman ..... F41A 21/48 42/71.01
3,566,744 A 3/1971 Stoner
5,540,008 A * 7/1996 Kirnstatter ..... F41A 21/484 42/75.02
6,301,817 B1 * 10/2001 Hogue ..... F41C 23/18 42/71.01
6,487,805 B1 * 12/2002 Reynolds ..... F41A 21/485 42/75.03
6,637,142 B1 * 10/2003 Reynolds ..... F41A 21/485 42/1.06
8,015,740 B2 * 9/2011 Jamison ..... F41A 21/00 42/14
8,881,444 B2 * 11/2014 Warburton ..... F41A 11/00 42/74
9,341,436 B2 * 5/2016 Frankel ..... F41C 23/00
2010/0083551 A1 * 4/2010 Jamison ..... F41A 21/485 42/75.01
2010/0162605 A1 * 7/2010 Laney ..... F41A 3/24 42/25
2011/0061523 A1 3/2011 Webb
2011/0185618 A1 * 8/2011 Jamison ..... F41A 21/00 42/75.03
2012/0167433 A1 7/2012 Robbins et al.
2012/0198990 A1 * 8/2012 Brittin ..... F41A 5/26 89/191.01
2014/0026460 A1 * 1/2014 Warburton ..... F41A 11/00 42/74
2014/0075802 A1 * 3/2014 Dubois ..... F41A 11/00 42/16

(Continued)

*Primary Examiner* — Derrick Morgan
(74) *Attorney, Agent, or Firm* — Douglas Baldwin

(57) ABSTRACT

Methods and structures for tightening the fit between upper and lower receiver subassemblies in a firearm comprising the addition of a raised embossment (projecting upward from the surface) on the upper side of a lower receiver walls or the underside of an upper receiver walls near the pivot pin. When the upper and lower receivers are connected by engaging the rear take-down pin the embossment leverages the receivers on the pivot pin to provide a tight fit.

16 Claims, 3 Drawing Sheets

(56) References Cited

U.S. PATENT DOCUMENTS

| | | | | |
|---|---|---|---|---|
| 2014/0196338 | A1 | 7/2014 | Lessard | |
| 2015/0059221 | A1* | 3/2015 | Bero | F41A 3/66 42/16 |
| 2015/0107144 | A1 | 4/2015 | DiChario | |
| 2015/0198397 | A1 | 7/2015 | Motley | |
| 2015/0316347 | A1* | 11/2015 | Shea | F41C 23/16 42/75.02 |
| 2015/0330733 | A1* | 11/2015 | DeSomma | F41A 3/66 42/6 |
| 2016/0033219 | A1* | 2/2016 | Meier | F41A 3/66 89/191.01 |
| 2016/0047623 | A1* | 2/2016 | Frankel | F41C 23/00 42/71.01 |

* cited by examiner

FIREARMS RECEIVER WITH INTEGRATED LOCKING JOINT

CROSS REFERENCE TO RELATED APPLICATIONS

The present application claims benefit of provisional patent application of 62/233,809 filed Sep. 28, 2015 the disclosures of which is hereby incorporated by reference in the entirety for all purposes.

BACKGROUND

Field of Invention

This invention is related to firearms and specifically a means to tighten the upper and lower receiver subassemblies in auto-loading firearms.

Background

In autoloading firearms with upper and lower receivers there is not a suitable way to allow the upper receiver sub-assembly of the firearm to maintain a connection to the lower receiver sub-assembly that is reliably snug and without any "play" or "slop" between the two primary firearm sub-assemblies. A tight connection between the two sub-assemblies is desired by precision shooters in order to keep the upper receiver sub-assembly from "torqueing" on the operator when being fired, which is otherwise known to result in down-range projectile accuracy degradation.

Because of varying tolerances in the manufacturing of upper and lower receivers it is nearly impossible to achieve a suitable fit. Loose fitting receivers will make even the best custom built rifle less than ideal for precision shooting. Many shooters solve the problem with a wedge under the upper receiver lug when the receiver is closed. It serves the purpose but is cumbersome to use. Among others, the company Tactable Innovations, Inc. makes a system employing a nylon tipped Allen wrench drive screw that, and with partial disassembly of the lower receiver subassembly, can be manually adjusted. The tensioning screw allows the user to exert pressure on the upper receiver for a more controlled upper receiver fit. While this tensioning screw works, it is more complex and failure-prone than is convenient and requires manual adjustment and maintenance, which includes substantial disassembly of the firearm.

The present invention provides a better solution.

DETAILED DESCRIPTION

The present invention provides a means for tightening the fit between upper and lower receiver subassemblies in a firearm comprising the addition of a raised embossment (projecting upward from the surface) on the upper side of a lower receiver walls or the underside of an upper receiver walls near the pivot pin. When the upper and lower receivers are connected by engaging the rear take-down pin the embossment leverages the receivers on the pivot pin to provide a tight fit.

Figure 1:
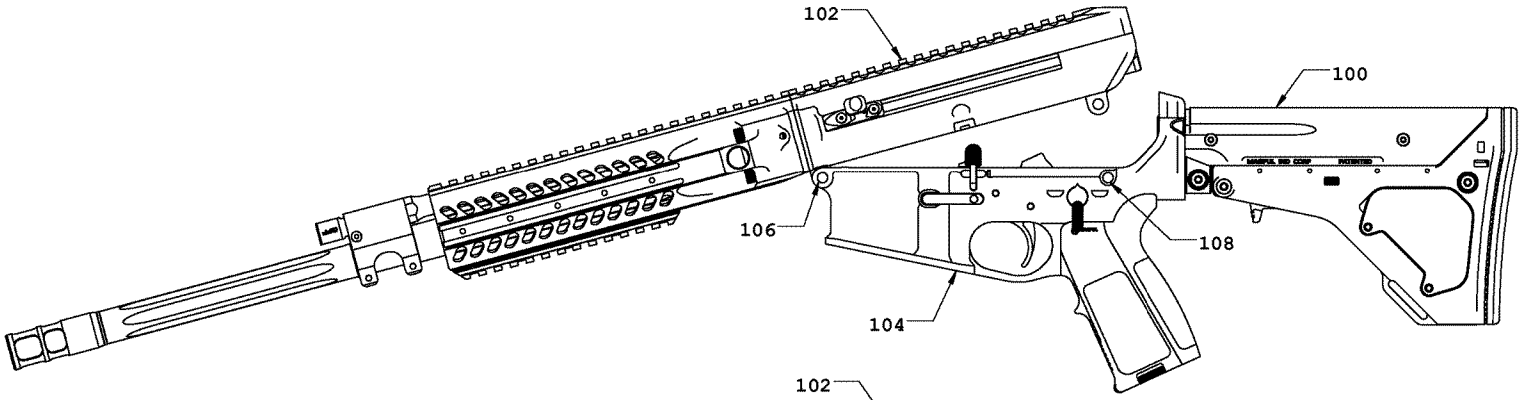
FIG. 1 is a side view of a firearm with an embodiment of the invention.
Figure 1A:
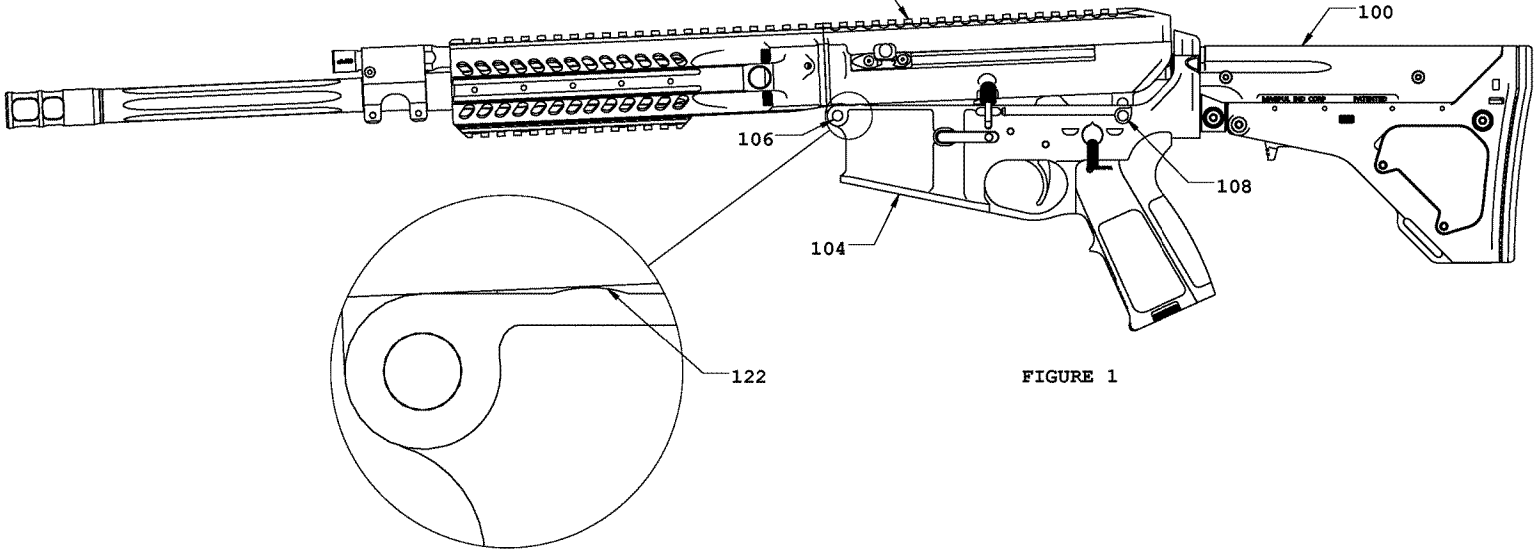
FIG. 1A is side view of a section of firearm with an embossment on the top side of a lower receiver of embodiment of the invention.
Figure 2:
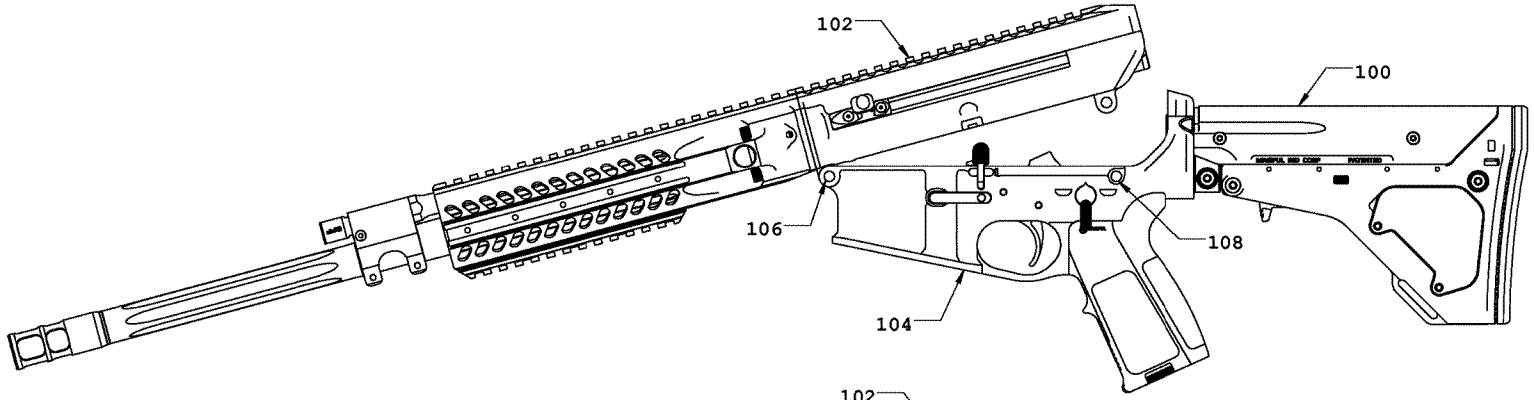
FIG. 2 is a side view of a firearm with an embodiment of the invention.
Figure 2A:
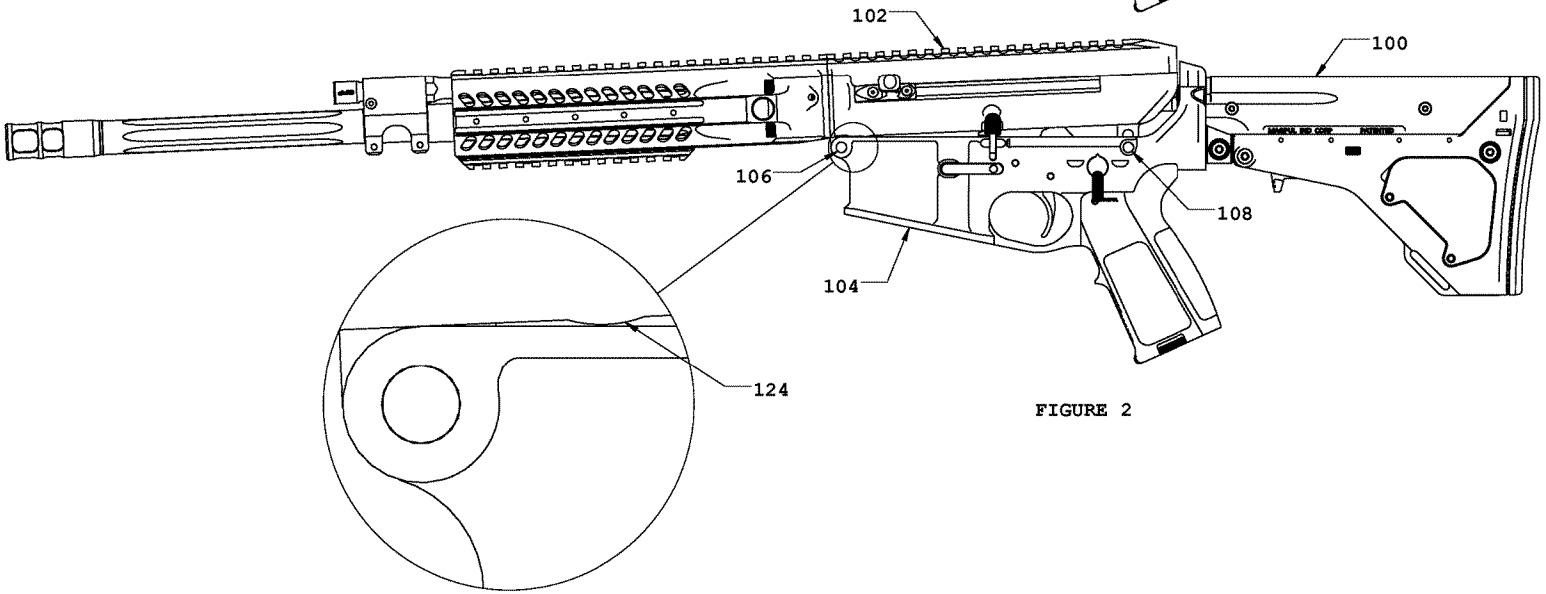
FIG. 2A is side view of a section of firearm with an embossment on the bottom side of an upper receiver of an embodiment of the invention.
Figure 4:
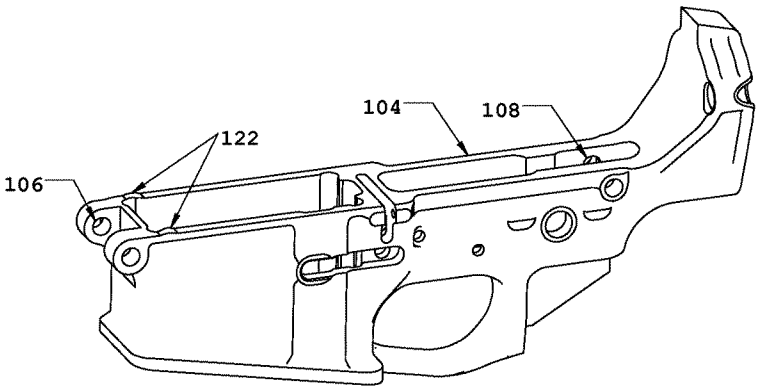
FIG. 4 is a perspective view of a lower receiver showing an embossment on the top rail surface in accordance with an embodiment of the invention.
Figure 6:
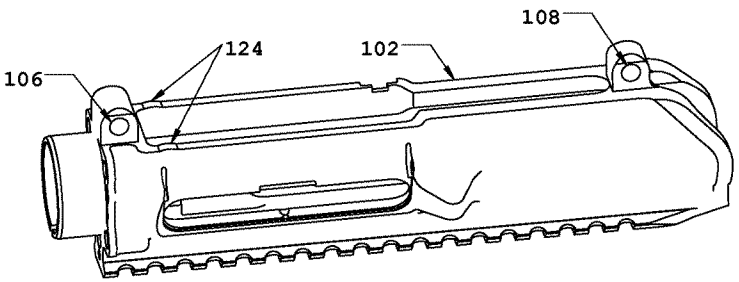
FIG. 6 is a perspective view of an upper receiver showing an embossment on the top rail surface in accordance with an embodiment of the invention
Figure 3:
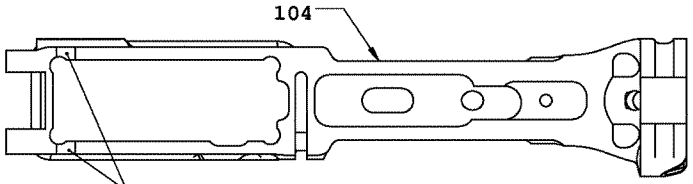
FIG. 3 is a top view of a lower receiver showing an embossment on the top rail surface in accordance with an embodiment of the invention.
Figure 5:
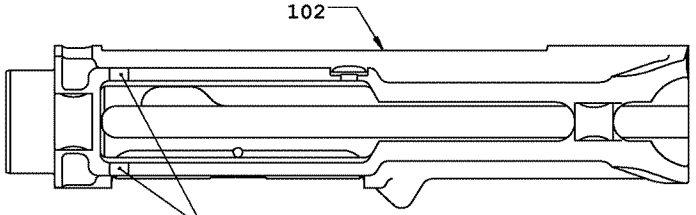
FIG. 5 is a top view of an upper receiver showing an embossment on the top rail surface in accordance with an embodiment of the invention.

Referring to the Figures, FIGS. 1 and 2 show embodiments of the invention. The firearm, 100, has an upper receiver subassembly 102 and lower receiver a subassembly 104. There is provided a front pivot pin 106 and a rear take-down pin 108. The upper and lower receiver subassemblies pivot on the pivot pin which is engaged into the front receiver bushings 112 (acting as a hinge) to be opened and closed. The receiver subassemblies are locked together by engagement of a rear take-down pin into the rear receiver bushings 114. The top surface of the lower receiver walls has an embossment, 122 (raised projection above the surface, preferably rounded as shown), near the pivot pin in FIGS. 1A, 3 and 4 in one embodiment of the invention. Alternatively, there is an embossment on the underside surface of the top receiver subassembly, 124, as shown in FIGS. 2A, 5 and 6. There may be an embossment on both the top and bottom receiver subassemblies but generally that is not required. The embossments may be machined into the top (or bottom) walls of receivers as an integral part thereof or may be a separate structure that is attached. The embossment (s) may be attached by depositing bonding or welding material on the walls and fashioning the bonding or welding material to the shape and size desired, they may be separate structures inserted into slots the walls or holes drilled into the walls. Alternatively, the embossment projection may be provided by threaded pieces inserted into threaded holes in the walls. When used the inserts or threaded embossments would allow the embossment to be custom sized for the particular subassemblies on which they are used.

With an embossment being machined into the lower receiver subassembly walls (or alternatively the top receiver subassembly), as shown in the Figures, the receiver subassemblies are snuggly (tightly fitted without significant movement) locked together when the rear take-down pin is engaged. The embossment places the subassemblies in bending tension when locked, thus resulting in a very tight and reliable connection that eliminates upper receiver torqueing. When the upper receiver subassembly is closed and pinned, a compressive pressure is applied to the embossment which thereby eliminates any ability of the upper receiver subassembly to have any connection-play with the lower receiver subassembly.

The embossment will be of sufficient height above the surface to leverage the lower (or alternatively the upper) to pull the upper and lower receivers into tight contact. In a prototype, the embossment height of between 0.002 to 0.020 inches has generally worked well.

The embossment will be located along the length of the receiver wall (top of lower or bottom of upper) at no more than 50% of the distance from the front pivot pin to the rear take-down pin. It is preferred to be located no more than 15% of the distance, and more preferably between 1-10%.

Locating the embossment near the front pivot pin allows more flexibility and the ability for the embossment to be most useful in tightening upper and lower receiver contact over a wider variation of fit. The tightness of the fit will vary slightly, but will in all cases be universally snug as compared to a similarly designed firearm having no embossment. Since the embossment is very close to the front hinge, more leeway is provided for compressive variability against the hinged connection. If the embossment was placed close to the rear take-down pin, there would not be much variability and some units would certainly be too tight or too loose. Experimentally, this arrangement was demonstrated with shim material disks, where 0.005"-0.010" upward projection has worked well when placed close to the front hinge. This upward projection did not need to be of an exact tolerance because of the close proximity to the front hinge allowed a wide range of compressibility.

In this specification, the invention has been described with reference to specific embodiments thereof. It will, however, be evident that various modifications and changes may be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

The invention claimed is:

1. A firearm having an upper and lower receiver subassembly and having a pivot pin and takedown pin wherein, the upper subassembly has lower walls having at least one inelastic, fixed, non-adjustable, machined in, raised projection embossment on the lower surface of the walls thereof to form a unitary body with the upper subassembly located within 50% of the length of the upper subassembly from a pivot pin and separate from a pivot pin mounting structure, said length being measured from the pivot pin to the take-down pin, the position, contact between the embossment and the lower subassembly and inelastic nature of the embossment provide a leveraged tension to enhance the fit of the upper and lower subassemblies when joined together.

2. The firearm of claim 1 wherein the raised projection embossment is within 1-10% of the length of the subassembly, said length being measured from a front pivot pin to a take-down pin.

3. The firearm of claim 1 wherein the raised projection embossment is 0.002 to 0.020 inches above the upper surface of the wall of the lower subassembly.

4. The firearm of claim 1 wherein the raised projection embossment is rounded at an edge above the upper surface of the wall of the lower subassembly.

5. A firearm having an upper and lower receiver subassembly and having a pivot pin and takedown pin wherein, the lower subassembly has upper walls having at least one inelastic, fixed, non-adjustable, machined in, raised projection embossment on the upper surface of the walls thereof to form a unitary body with the lower subassembly located within 50% of the length of the lower subassembly from a pivot pin and separate from a pivot pin mounting structure, said length being measured from the pivot pin to the take-down pin, the position, contact between the embossment and the upper subassembly and inelastic nature of the embossment provide a leveraged tension to enhance the fit of the upper and lower subassemblies when joined together.

6. The firearm subassembly of claim 5 wherein the raised projection is within 1-10% of the length of the subassembly, said length being measured from a front pivot pin to a take-down pin.

7. The firearm receiver subassembly of claim 5 wherein the raised projection embossment is 0.002 to 0.020 inches above the surface.

8. The firearm subassembly of claim 5 wherein the raised projection embossment is rounded at an edge above the surface of the wall.

9. A method of tightening the fit of an upper and lower receiver subassemblies of a firearm, the subassemblies having side walls, comprising:

providing an inelastic, fixed, non-adjustable, machined in, embossment consisting of a raised projection from the surface of walls to form a unitary body with either the lower side of the upper subassembly or the upper side of the lower subassembly, the raised projection embossment being within 50% of the length of the subassembly from a pivot pin and separate from a pivot pin mounting structure, said length being measured from the pivot pin to the take-down pin, the size, inelasticity, contact between the embossment and the other of the upper and lower subassembly and positioning of the embossment providing a leveraged tension to enhance to fit of the upper and lower subassembly, and locking the subassemblies together by engagement of the take-down pin.

10. The method of claim 9 wherein the raised projection embossment is within 1-10% of the length of the subassembly, said length being measured from a front pivot pin to a take-down pin.

11. The method of claim 9 wherein the raised projection embossment is 0.002 to 0.020 inches in above the upper surface of the lower subassembly.

12. The method of claim 9 wherein the raised projection embossment is rounded at an edge above the upper surface of the wall of the lower subassembly.

13. The firearm of claim 1 wherein the inelastic projections of 1) and 2) comprise the same material as the respective subassembly surface.

14. The firearm of claim 13 wherein the inelastic projections of 1) and 2) are integral with of the subassembly.

15. The firearm of claim 1 wherein the inelastic fixed non-adjustable projections of 1) and 2) are attached by depositing bonding or welding material on the respective subassembly surface or separate structures inserted into slots or holes drilled into the respective subassembly surface or threaded pieces inserted into threaded holes in the respective subassembly surface.

16. The firearm of claim 1 wherein the inelastic projections of 1) and 2) the inelastic fixed non-adjustable projection embossment has a cross section dimension in any direction no greater than about twice the width of the respective subassembly surface on which it is attached.

* * * * *